United States Patent [19]

Guillot et al.

[11] 4,326,435

[45] Apr. 27, 1982

[54] HYDRAULIC POWER TONG

[76] Inventors: Preston F. Guillot, 132 St. Judge St., Marrero, La. 70072; Sheldon W. Guthrie, Jr., 428 Willowbrook, Gretna, La. 70053

[21] Appl. No.: 162,521

[22] Filed: Jun. 24, 1980

[51] Int. Cl.[3] ..... B25B 13/50

[52] U.S. Cl. ..... 81/57.34; 81/57.16

[58] Field of Search ..... 81/57.33, 57.34, 57.35, 81/57.16

[56] References Cited

U.S. PATENT DOCUMENTS

| | | | |
|---|---|---|---|
| 2,544,639 | 3/1951 | Calhoun | 81/57.16 |
| 2,737,839 | 3/1956 | Paget | 81/57.34 |
| 2,760,392 | 8/1956 | Paget | 81/57.16 |
| 3,025,733 | 3/1962 | Soodnizin | 81/57.16 |
| 3,246,547 | 4/1966 | O'Neill et al. | 81/57.34 |
| 4,023,449 | 5/1977 | Boyadjieff | 81/57.35 |
| 4,147,215 | 4/1979 | Hodge et al. | 81/57.34 |

*Primary Examiner*—James L. Jones, Jr.
*Attorney, Agent, or Firm*—Keaty & Keaty

[57] ABSTRACT

A power tong apparatus provides a housing having a vertical U-shaped slot allowing a vertically supported length of drill pipe to be inserted into the slot coincident with a provided vertical axis of the slot. An upper and lower jaw assembly is provided in its respective jaw assembly carriage. The jaw assemblies are rotationally mounted within the respective jaw carriages and are powered by hydraulic cylinders. Four laterally extending chambers are provided which allow the hydraulic cylinders to be moved between left and right positions which combined with an inverting of the respective jaw assembly different rotational directions to each jaw assembly. Thus, the same jaw assemblies can be used to make up or disassemble pipe joints together. Openings are provided in the housing for the insertion of hydraulic lines into the housing for connection to the respective hydraulic cylinders. Cover plates provided externally on each laterally extending chamber allow for easy access to the hydraulic cylinder connections. Similarly, upper and lower cover plates allow for easy access to the respective upper and lower jaw assemblies. Teeth provided on each jaw assembly are removable for ease of replacement.

13 Claims, 12 Drawing Figures

B
0
30

40
42
50

B
33
60
34
60
21
T
212
23
13
210
14
15
35
12
16
36
31
24
20

HYDRAULIC POWER TONG

BACKGROUND OF THE INVENTION

1. Field of the Invention

The present invention relates to an oil field apparatus or tool, and more particularly relates to an improved power tong. Even more particularly, the present invention related to an improved power tong providing jaw assemblies which are rotationally mounted within the respective jaw carriages and are powered by hydraulic cylinders. Even more particularly, extending jaw chambers are provided which allow the hydraulic cylinders to be moved between left and right positions which combined with an inverting of the respective jaw assembly different rotational directions to each jaw assembly.

2. General Background and Prior Art

In the oil field and in oil/gas drilling, there is often utilized a "power tong" for making up and breaking up sections of drill pipe, casing, or other like piping assemblies which are generally made up into strings from a plurality of joints. Many of these power tongs are in use which quickly make or break the desired connection using power supplied by an electric or hydraulic motor, for example. In general, power tongs of this type have clutch, drag or brake assembly which transforms rotary power through a gear reduction system into gripping power through a cam mechanism, thus allowing the pipe to be gripped at the joint and the desired torque applied. Power tongs of this type are known.

In U.S. Pat. No. 2,862,690 issued to James C. Masou, which provides for a power driven device for rotating piping or casing utilizing a series of endless belt in the rotating of the pipes.

In U.S. Pat. No. 3,793,913 issued to Carl A. Wilms, there is provided a power tong for making up and breaking up pipe adapted with a reverse stop means.

In U.S. Pat. No. 3,144,794 issued to J. L. Foster entitled "Power Driven Sucker Rod Wrench," relates to a power actuated sucker rod tong or wrench, and more particularly to a wrench mechanism for connecting and disconnecting the screw threaded joints of pump rods.

U.S. Pat. No. 4,084,453 issued to E. L. Eckel, entitled "Power Tong" includes a power tong which has a frame and pipe gripping mechanism associated with a throat at one end of the frame wherein power is transmitted to the pipe gripping mechanism from a power unit through a drive train.

U.S. Pat. No. 2,509,853 issued to N. K. Wilson entitled "Tubing and Rod Handling Tool," wherein a tool is provided with a frame having a roller means adapting the frame to roll up on a track having clamp means at one end for connection upon a well casing thereto.

U.S. Pat. No. 3,541,897 issued to H. D. Horton entitled "Power Tubing Tongs," wherein is included an external housing having a bull gear assembly disposed for the major circumferential difference thereby with the external housing being adapted to receive a removable internal jaw section therein.

U.S. Pat. No. 3,892,148 issued to Mark H. Wiley, entitled "Adjustable Power Spinning Tongs" provides an apparatus which involves a power spinning tong of the type having rollers which grip the pipe and some of its rollers are rotatable to drive the pipe rotatively, the rollers being revolvable on lever arms that can be opened to allow the tong to be applied to and removed from the pipe.

U.S. Pat. No. 4,005,621 issued to J. W. Turner, Jr. and Russell A. McLaughlin entitled "Drilling Tong," which utilizes an open head tong of the type utilized to handle large diameter work pieces, such as drill pipe and casing for oil field application and including means to adjustably engage peripheral portions of such work pieces.

U.S. Pat. No. 4,060,014 issued to John W. Turner, Jr. entitled "Power Tong" provides for an open head power tong for use in making up and breaking up joints of varying diameter such as drill pipe joints which provides for bidirectional operation with the tong housing remaining in the same position.

U.S. Pat. No. 3,021,739 issued to J. F. Grundmann entitled "Hydraulically Controled and Operated Power Tong," which includes a rotatably mounted head portion having an opening in which a cylindrical member may be positioned coincident with the axis of rotation of the head portion and there is a power means operable to rotate said head portion, said gripping members being actuatable into gripping engagement and out of gripping engagment.

U.S. Pat. No. 2,741,460 issued to R. I. Gardner entitled "Power Tongs and Control System Therefor," which provides for a power wrench including a housing which provides an annular stator, an annular rotor carrying a suitable pipe gripping structure being disposed within the annular stator and being rotatable about the axis thereof.

U.S. Pat. No. 2,703,221 issued to R. I. Gardner entitled "Power Tong," which is essentially the same apparatus as the previous patent to the same inventor.

Most prior art devices as is evidenced from the prior arts patents cited are extremely complex in construction and are difficult and/or impossible to replace in the field should the need arise. Further, they are generally constructed so that there are numerous moving parts and are drive train apparatus, gears, etc. which the use of oil field work require immediate attention should a breakdown occur which indeed does happen very often.

3. General Description of the Present Invention

The present invention provides an improved power tong apparatus which would comprise a housing having a U-shaped vertical slot with a vertical axis which would normally be occupied by a pair of pipe lengths to be assembled or disassembled as in oil field work. The apparatus would also have a pair of jaw assemblies which would be movably mounted on a housing and adapted with a pair of oppositely oriented hydraulic cylinders which would be connected respectively to the pair of jaw assemblies and produce opposite rotational motion of each. Each jaw assembly would be powered during the operation by one of said cylinders to a first pipe gripping position and thereafter to a second pipe rotating position. In the embodiment, the pair of jaw assemblies would be cylindrical and are mounted within the cylindrical recesses provided respectively in the upper and lower portions of the housing. A pair of upper laterally extending chambers and a pair of lower laterally extending chambers would further comprise the housing.

Therefore, it is an object of the present invention to provide an improved power tong apparatus which is adapted for receiving pipe lengths for assembling and disassembling.

It is further an object of the present invention to provide a power tong which would be adapted with oppositely oriented hydraulic cylinders being connected to a pair of jaw assemblies and producing opposite rotational motion of each, therefore enabling assemblage and disassemblage of pipe lengths.

It is a further object of the present invention to provide a power tong where the pair of jaw assemblies are cylindrical and mounted within cylindrical recesses respectively in the upper and lower portions of the housing.

It is another object of the present invention to provide a power tong which is of simplified construction for hydraulically driven jaws for assembling and disassembling sections of pipe in the oil field industry.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figures 1, 2, 3:
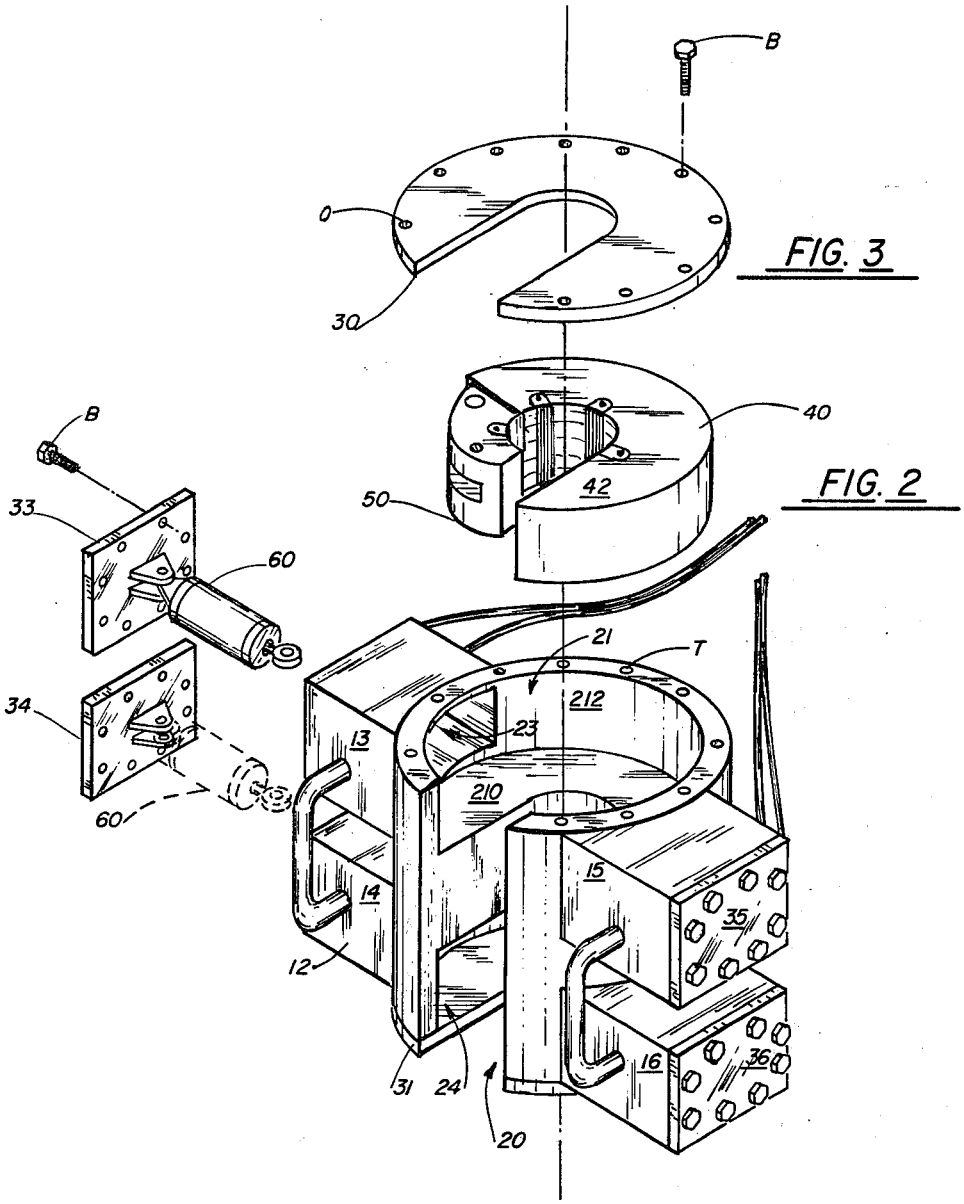
FIG. 1 is an exploded perspective view of the power tong apparatus of the preferred embodiment of the apparatus of the present invention illustrating the body, hydraulic cylinder an anchor plate portions thereof.
FIG. 2 is a perspective view of the jaw assembly portion of the preferred embodiment of the apparatus of the present invention.
FIG. 3 is a perspective view of the cover plate portion of the preferred embodiment of the apparatus of the present invention.

FIG. 1 best shows the preferred embodiment of the apparatus of the present invention as generally comprising housing 12, to which are attached in the preferred embodiment a pair of hydraulic cylinders 60 attached respectively to anchor plates 33–36 at one end portion thereof and to jaw assemblies 40 as will be described in more fully hereinafter. Housing 12 provides an upper 21 and a lower 22 jaw assembly carriage which are recesses provided respectively in the upper and lower portions of body 12 and which movably house respectively a jaw assembly 40 during operation. Cover plates 30, 31 are affixed by bolting, for example, using bolts B after each jaw assembly 40 has been placed into its respective jaw assembly carriage 21, 22.

FIGS. 7–12 best illustrate the particular construction of housing 12. Each housing 12 provides a vertically extending U-shaped recess 20 which allows the entrance of a length or a pair of joints of drill pipe 63, 64 there into.

Figure 8:
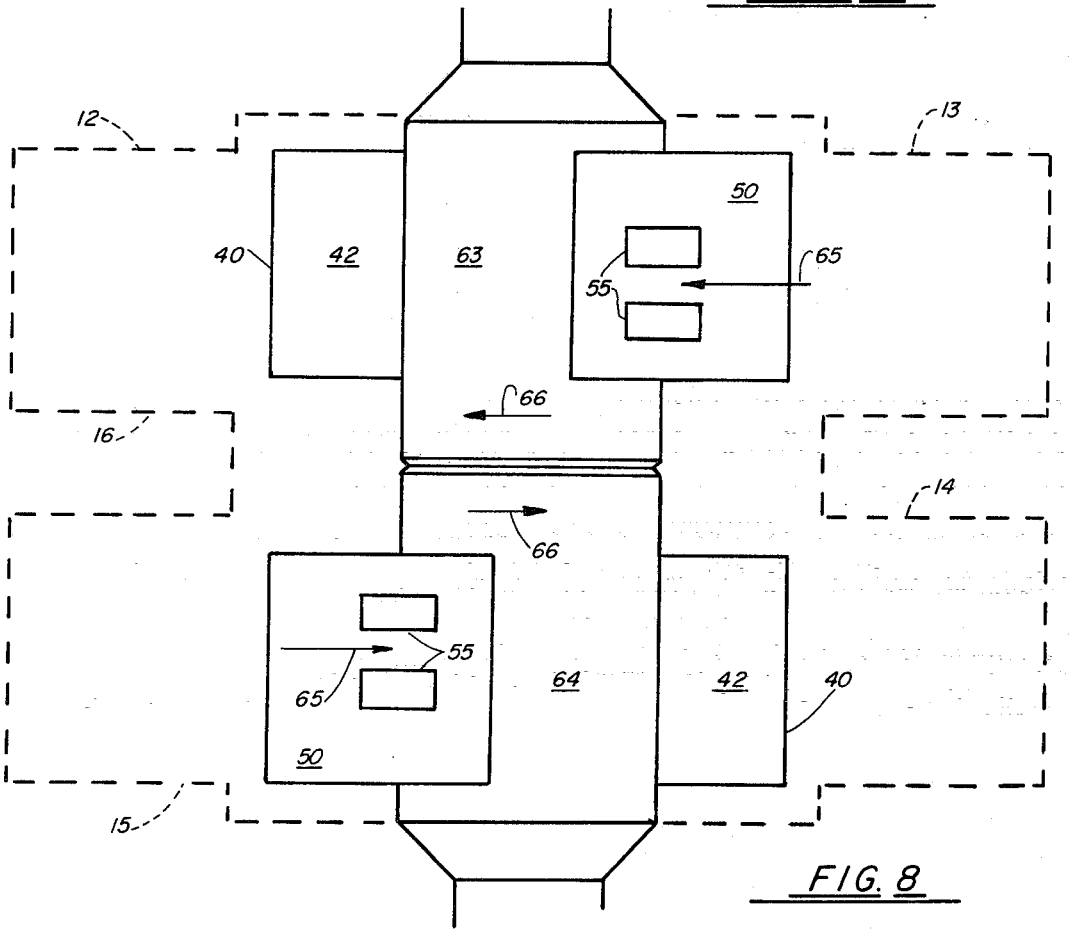
FIG. 8 is a phantom front view of the preferred embodiment of the apparatus of the present invention illustrating the housing in phantom lines, and the upper and lower jaw assembly portions while gripping two connected joints of drill pipes.
Figure 9:
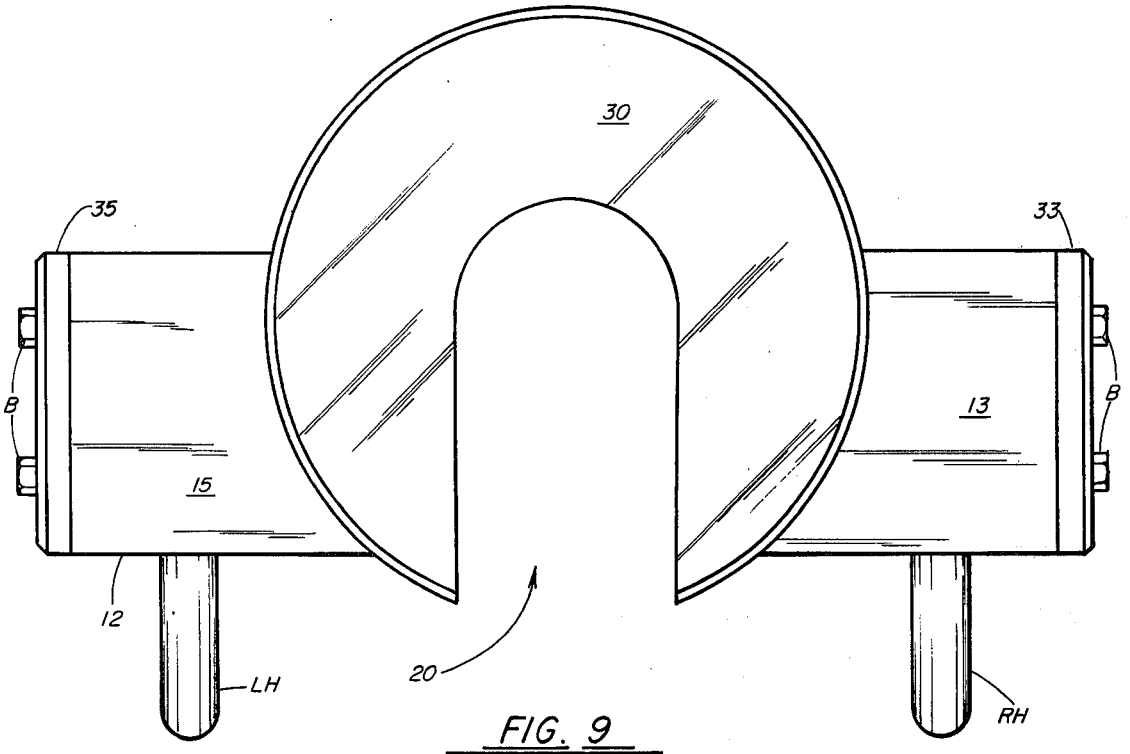
FIG. 9 is a top view of the housing portion of the preferred embodiment of the apparatus of the present invention.
Figure 10:
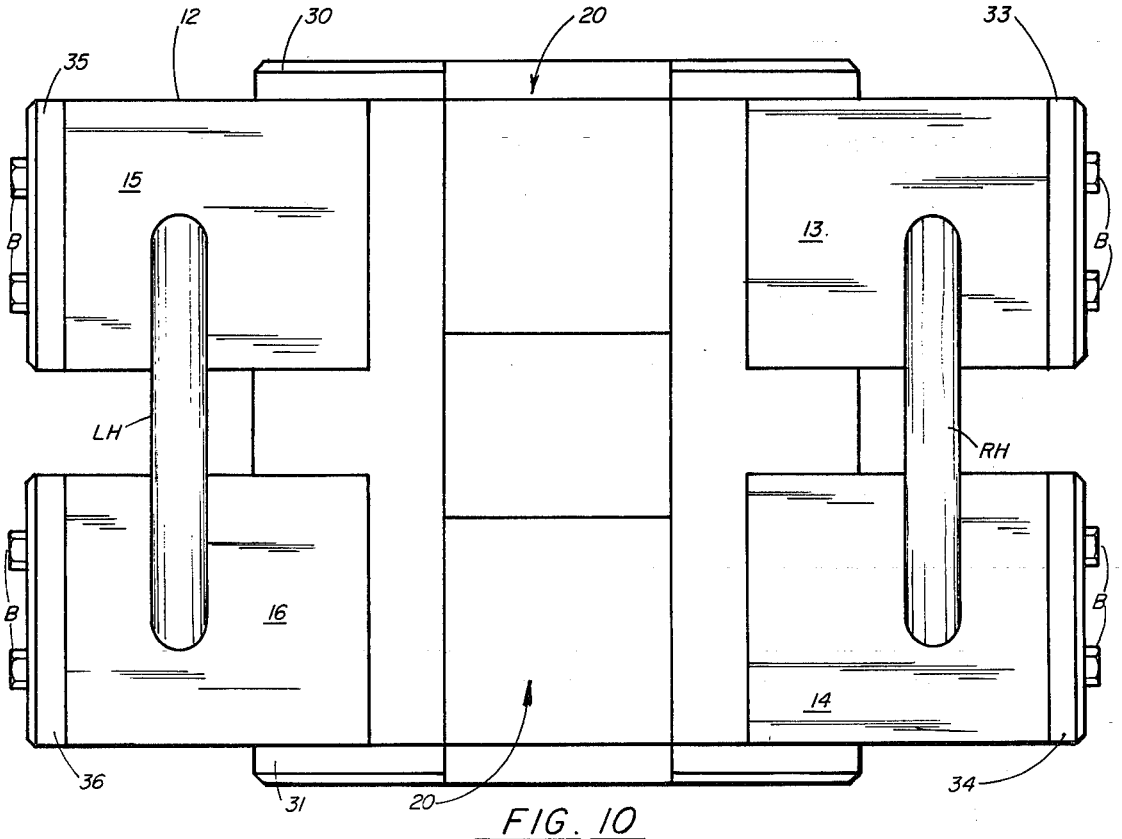
FIG. 10 is a front view thereof.
Figure 11:
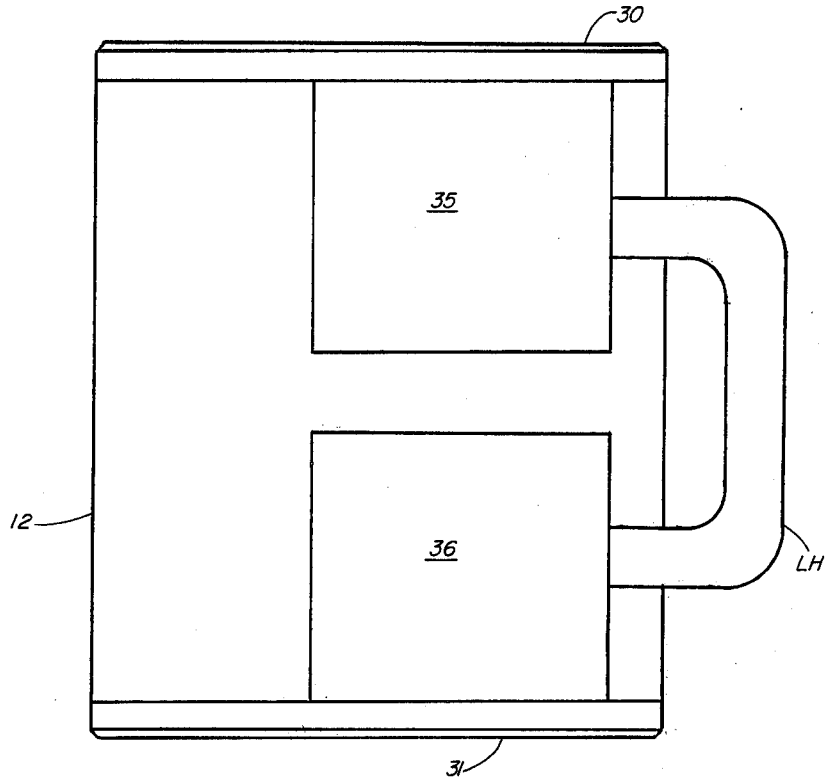
FIG. 11 is a side view thereof.

Body 12 provides also four laterally extending chambers 13–16, each chamber providing its respective inner chamber bore 23–26. Chamber bores 23–26 communicate respectively with U-shaped slot 20 on the interior portion of housing 12 and are open externally. At such external openings, a plurality of anchor plates 33–36 are provided to correspond with the four laterally extending chambers 13–16. In the drawings, four anchor plates 33, 34, 35 and 36 are provided which bolt, for example, respectively to chambers 13–16 as can be seen in the drawings. In FIG. 1, anchor plates 33–34 are shown in an exploded view each providing bolts B as well as peripheral openings in each anchor plate through which bolts B will be inserted upon assembly. Receptive threaded sockets would be provided by milling such female threaded sockets into the respective chambers 13–16 so that bolts B could be tapped directly into each respective chamber and fasten the respective anchor plate 33–36 to the respective laterally extending chamber 13–16. It should be understood at this point, that each anchor plate 33–36 will be called upon to act as an anchor for a hydraulic cylinder 60 which will bear respectively against an anchor plate 33–36 and jaw assembly 40 to generate the necessary compressive force to operate power tong 10 and to take apart and put together joints of drill pipe as schematically shown in FIG. 8 by arrows 66.

Figure 7:
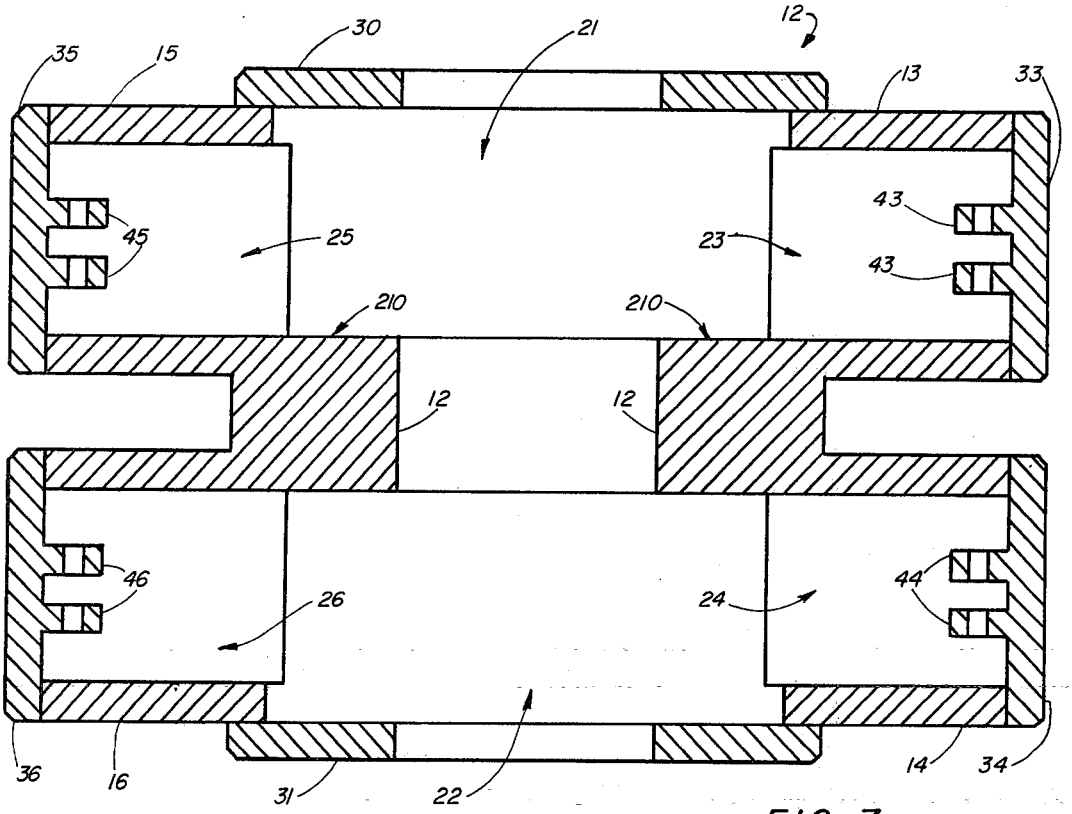
FIG. 7 is a sectional view of the housing portion of the preferred embodiment of the apparatus of the present invention.

Each anchor plate 33–36 provides a pair of brackets which will allow one end portion of hydraulic cylinder 60 to be attached thereto by pinning, for example, as shown in FIG. 1. In FIG. 7, a pair of brackets can be seen provided with each anchor plate 33–36 with such pairs of brackets being designated by the numerals 43–46 in FIG. 7.

The front portion of housing 12 provides handles LH and RH which handles aide in the manipulation of housing 12 when it is supported, for example, by a crane, or lift or the like. Handles LH, RH would merely be for lateraly movement of body 12 and not for its support. A suitable crane or the like would be required to support housing 12 during operation.

Figure 12:
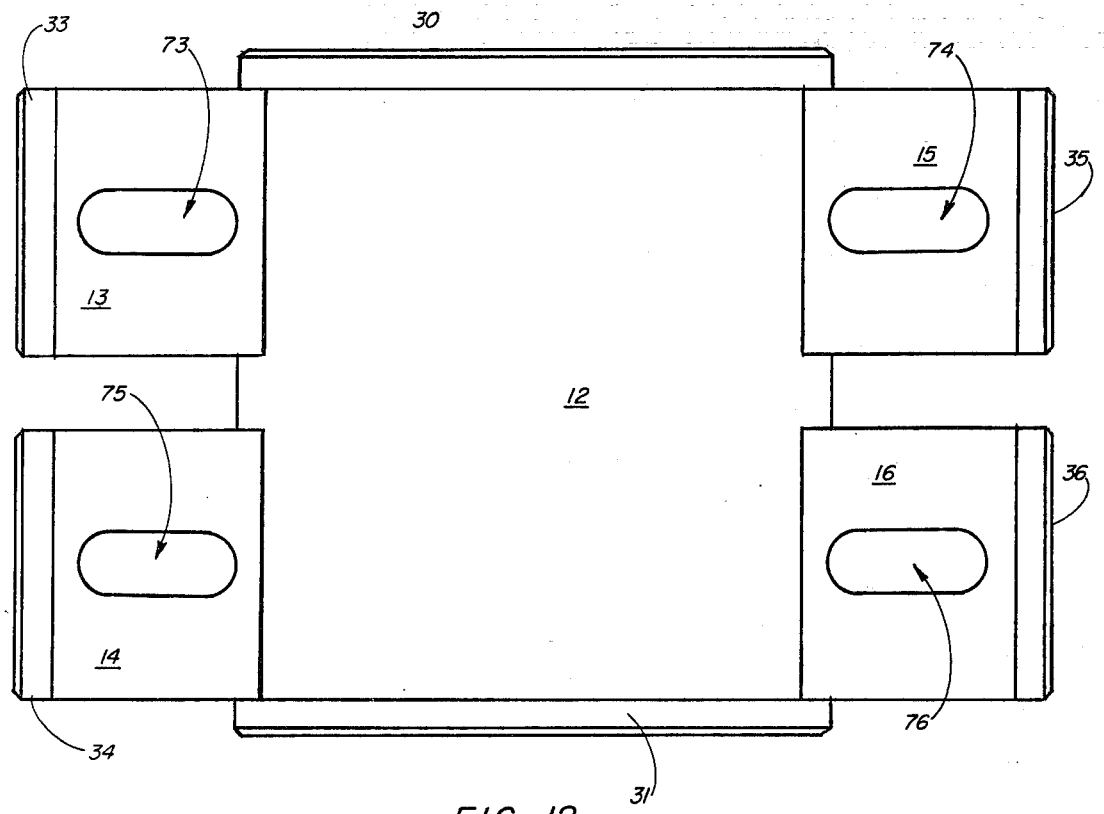
FIG. 12 is a rear view thereof.

FIG. 12 also illustrates hydraulic line receiving ports 73–76, which accommodate the hydraulic lines 17 (shown in FIG. 1) into the power tong assembly for operation of the hydraulic cylinder 60.

Figure 4:
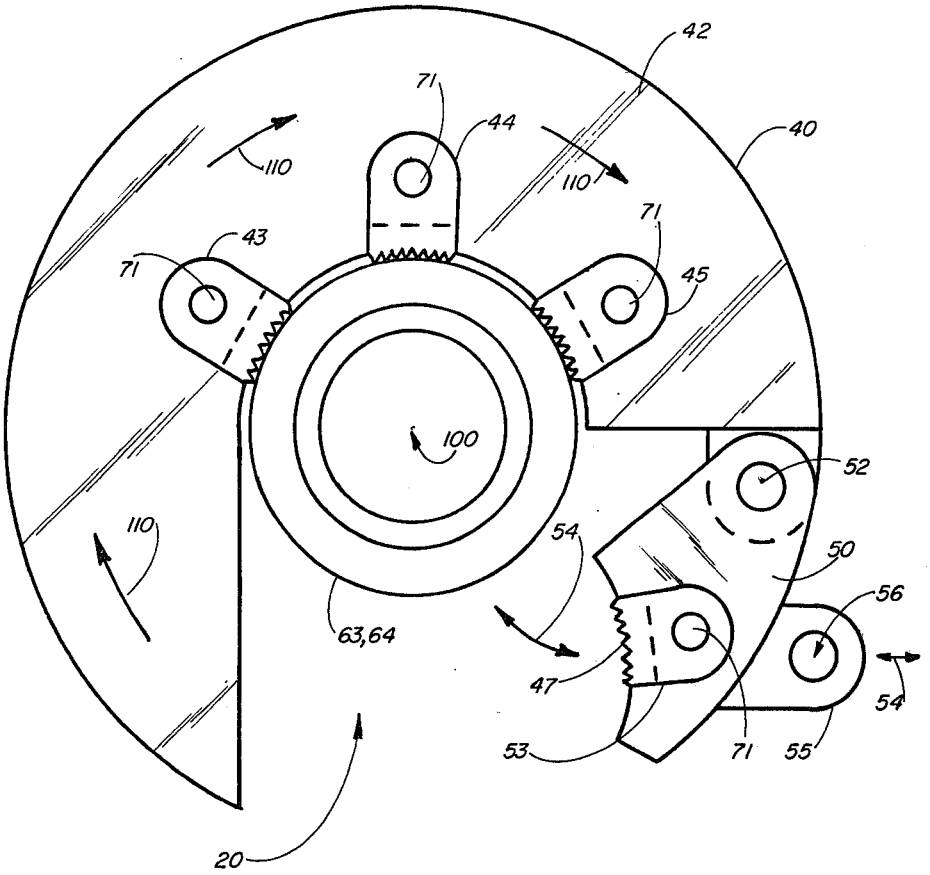
FIG. 4 is a top view of the jaw assembly portion of the preferred embodiment of the apparatus of the present invention with a section of drill pipe being schematically illustrated.
Figure 5:
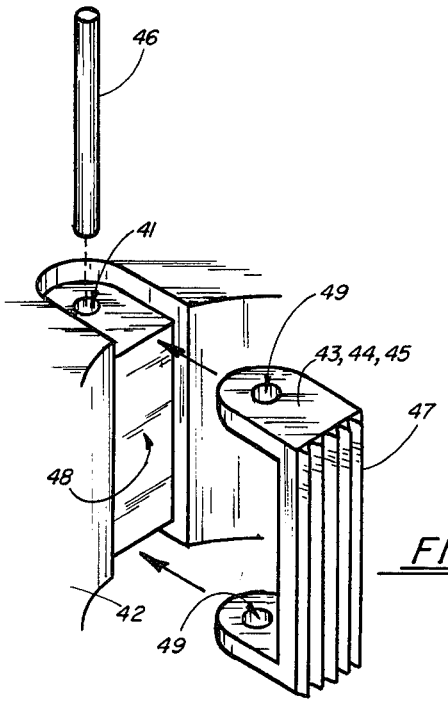
FIG. 5 is a perspective view of a removable tooth element portion of the preferred embodiment of the apparatus of the present invention.
Figure 6:
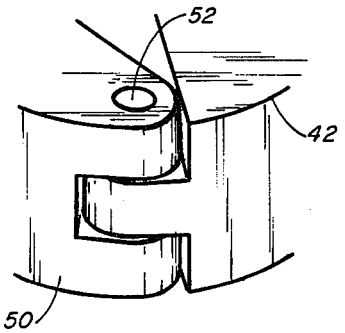
FIG. 6 is a detailed perspective view of the movable jaw and jaw carriage portions of the preferred embodiment of the apparatus of the present invention.

FIGS. 4–6 show with particularity the construction of jaw assembly 40. It should be appreciated that two jaw assemblies will be required, an upper jaw assembly and a lower jaw assembly each designated in the drawing as 40. These jaw assemblies will be mounted respectively at the upper and lower portion of housing 12 respectively in upper jaw assembly carriage 21 and lower jaw assembly carriage 22. Carriage 21 in the preferred embodiment is comprised of a lower annular support surface 210 and a generally cylindrical side wall 212. Once the respective jaw assembly 40 is placed in its assembly carriage 21, 22 it rests as best seen in FIG. 1 upon surface 210 being surrounded by side wall 212.

3. The apparatus of claim 2 wherein said hydraulic cylinder attaches respectively at one end portion to one of said laterally extending chambers and at its other end portion to the movably jaw portion of said jaw assembly.

4. The apparatus of claim 1 wherein said hydraulic cylinder means comprises at least one hydraulic cylinder.

5. The apparatus of claim 1 wherein said movable jaw portion can be powered by said hydraulic cylinder means to a first gripping position against a length of drill pipe and thereafter rotated with said jaw body to impart a rotational spin to said drill pipe.

6. The apparatus of claim 1 wherein said movable jaw portion is pivotally mounted to said jaw body.

7. The apparatus of claim 1 wherein said toothed elements are removably attached to said movable jaw and to said body.

8. A power tong apparatus comprising:

a. a housing having a vertical U-shaped slot allowing a vertically supported length of drill pipe to be inserted into said slot coincident with a provided vertical housing axis which also defines the axis of said U-shaped slot;

b. upper and lower jaw assembly carriages, each of said carriages being cylindrical recesses formed respectively in the upper and lower portions of said housing, said recesses being symmetrical about said housing vertical axis;

c. a first toothed cylindrical jaw assembly rotatably supported within said first jaw carriage;

d. a second toothed cylindrical jaw assembly rotatable within said second jaw carriage and movable in a different rotational direction with respect to said first jaw assembly; each of said jaw assemblies comprising:

i. a jaw body;

ii. a movable jaw pivotally attached to said jaw body;

iii. removable jaw elements attached respectively to said jaw body and said movable jaw.

e. a pair of powered jaws carried respectively on said upper and lower jaw assemblies for clamping a section of vertically supported drill pipe;

f. a pair of hydraulically powered cylinders attached respectively at one end portion to said housing and at their opposite end portion respectively to said pair of jaw assemblies, each of said hydraulic cylinders being removably affixed to different positions on said housing, each of said different positions allowing said cylinders to rotate their respective jaw assemblies in opposite rotational directions.

9. The apparatus of claim 8 wherein each of said jaw assemblies can be inverted within its associated jaw assembly carriage.

10. The apparatus of claim 8 further comprising a pair of upper laterally extending chambers and a pair of lower laterally extending chambers, each of said chambers being generally opposite from one another but symmetric about said axis, each of said chambers further providing attachment means for attaching said hydraulic cylinder thereto at one end portion thereof.

11. A power tong apparatus comprising:

a. a housing having a U-shaped vertical slot with a vertical axis normally occupied by a pair of pipe lengths to be assembled or disassembled;

b. a pair of cylindrical jaw assemblies movably mounted within cylindrical recesses provided respectively in the upper and lower portions of said housing;

c. a pair of oppositely oriented hydraulic cylinders being connected respectively to said pair of jaw assemblies and producing opposite rotational motion of each, each jaw assembly being powered during operation by one of said cylinders to a first pipe gripping position and thereafter to a second pipe rotating position.

12. The apparatus of claim 11 wherein said housing further comprises four laterally extending chambers, a pair of upper laterally extending chambers and a pair of lower laterally extending chambers, and each of said laterally extending chambers provides attachment means for attaching one end portion of said hydraulic cylinders thereto.

13. The apparatus of claim 11 wherein each of said pair of jaw assemblies comprises:

a. a jaw body;

b. a movable jaw pivotally attached thereto; and c. a movable jaw bracket being provided on said movable jaw with an end portion of said hydraulic cylinder being attached thereto during operation for imparting powered pivotal movement to said movable jaw.

* * * * *

Cover plate 30 would then be bolted in position by the plurality of bolts B as seen in FIG. 3 which would be inserted through the openings 0 also seen in FIG. 3 and then into the threaded taps T as seen in FIG. 1. This would be the same fashion for attaching anchor plates 33–36 to housing 12.

Each jaw assembly 40 comprises generally jaw body 42 and movable jaw 50. Upon jaw body 42 there is provided a plurality of removable teeth elements 43–45 each of which occupies a recess 48 milled upon body 42 with pin 71 being inserted through openings 49 of toothed element 43–45. Teeth 47 are seen which teeth are vertically oriented to be substantially parallel with axis 100. Axis 100 as best seen in FIG. 4 defines the center of generally U-shaped slot 20 and defines the vertical axis of housing 12 as well as the vertical axis of pipe 63, 64. In FIG. 4 arrows 110 define the rotation of body 42 during operation about axis 100.

In FIG. 4 there is also seen movable jaw 50. Note that jaw 50 swings in and out away from pipe 63, 64 as best seen by the arrows 54 in FIG. 4. This is because movable jaw 50 rotates about pivot 52 which is more clearly seen in FIG. 6 as the connection between movable jaw 50 and jaw body 42. An additional jaw element 53 is provided on movable jaw 50 which element would be attached thereto as was shown in FIG. 5 with respect to the toothed elements 43–45 mounted on jaw body 42. Likewise, a plurality of vertically oriented serrations are teeth 47 are provided to toothed element 53.

A pair of brackets 55 are structurally attached to movable jaw 50, each bracket 55 having an opening 56 through which a suitable pin could be inserted. This pair of brackets 55 allows for the attachment of one end portion of hydraulic cylinder 60 thereto. This arrangement is best seen in FIG. 1, though in that figure cylinder 60 is attached to a similar bracket arrangement on anchor plate 33. The same type of connection as seen in FIG. 1 would attach the opposite end portion of cylinder 60 to bracket 55. One skilled in the art will recognize that the extension and contraction of cylinder 60 will produce a rotational or pivotal movement of movable jaw 50 about pivot 52 as seen in FIG. 6. This will cause movable jaw 50 to rotate inwardly into a gripping position against pipe 63, 64. In such a gripping position, pipe 63, 64 would be held within U-shaped slot 20 and would be disallowed from escaping therefrom.

Since jaw body 42 is cylindrical and mounted within cylindrical carriage 21, it can rotate there within. One skilled in the art will appreciate that further extension of cylinder 60 after movable jaw 50 has been rotated fully inward to grip pipe 63 will thereafter produce a rotation about axis 100 of jaw body 42, this rotation indicated by the arrows 110 in FIG. 4. It should be appreciated that all gripping toothed elements 43–45 as well as element 53 will be gripping pipe 63, 64 and thus a rotation of pipe 63, 64 will be achieved in the rotational direction indicated by arrows 110.

A lower jaw assembly will likewise be provided within lower jaw assembly carriage 22 as best seen in FIGS. 7–8. Otherwise, the construction of jaw assembly 40 would be identical to that shown in FIG. 4. However, cylinder 60 would be attached in a lower laterally extending chamber opposite from the chamber in which cylinder 60 was mounted with respect to upper carriage. Thus, one can see from the above that rotational directions which are opposite will be imparted to upper and lower jaw assemblies 40 respectively. Since four laterally extending chambers 13–16 are provided, two upper chambers 13, 15 and two lower chambers 14, 16 it will be appreciated that different rotational directions can be achieved to upper jaw assembly itself and to lower jaw assembly itself. In order to achieve a different rotational direction, cylinder 60 would be moved from chamber 13 to chamber 15 and attached at its end portions respectively to bracket 45 and bracket 55. Jaw assembly 40 would merely be removed from its upper jaw assembly carriage 21 and inverted. Its orientation would be a mirror image of that shown in FIG. 4 and it would thus impart a different rotational direction to pipe 63, 64. A similar reversal could be achieved in lower jaw assembly 40.

From the above, one can see that the overall apparatus can be made to either take apart or put together joints of pipe. All that is required is that the jaw assemblies 40 be arranged in opposite directions and that the upper and lower hydraulic cylinders be mounted in opposite laterally extending chambers.

Housing 12 could be manufactured of any suitable structural material such as cast metal.

Jaw assembly 40 would be manufactured of a suitable metal or like durable material with hardened steel or the like being used to manufacture toothed elements 43–45 and 53.

Likewise, anchor plates 33–36 would be manufactured of a structural material such as cast metal or the like as would be cover plate 30 and 31.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A power tong apparatus comprising:

a. a housing having a vertically arranged U-shaped bore allowing for the insertion of a section of vertically supported drill pipe there into, said bore having a vertical axis;

b. upper and lower cylindrical jaw assemblies carried respectively in the upper and lower portion of said housing, and mounted within cylindrical recesses provided respectively in the upper and lower portions of said housing, each of said jaw assemblies comprising:

i. a jaw body having a U-shaped slot and being rotatably supported by said housing;

ii. a movable jaw portion movably mounted on said jaw body;

iii. toothed elements mounted on said jaw body and on said movable jaw, said toothed elements facing inwardly towards said vertical axis;

c. hydraulic cylinder means for powering said jaw assemblies in opposite rotational directions; and d. clamp means associated with each of said upper and lower jaw assemblies for clamping a length of pipe inserted into said slots for rotation with said respective upper and lower jaw assemblies.

2. The apparatus of claim 1 wherein said housing provides four laterally extending chambers, a pair of upper opposed chambers and a pair of lower opposed chambers, and said hydraulic cylinder means is removably attachable to any one of said laterally extending chambers at one end portion thereof and its other end portion thereof to either said upper or said lower jaw assembly.